US006498344B1

(12) United States Patent
Littlejohn

(10) Patent No.: US 6,498,344 B1
(45) Date of Patent: Dec. 24, 2002

(54) TRIODE ION PUMP

(75) Inventor: Duane P. Littlejohn, Manlius, NY (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 163 days.

(21) Appl. No.: 09/676,822

(22) Filed: Oct. 2, 2000

Related U.S. Application Data

(60) Provisional application No. 60/157,499, filed on Oct. 4, 1999, provisional application No. 60/157,498, filed on Oct. 4, 1999, provisional application No. 60/157,374, filed on Oct. 1, 1999, provisional application No. 60/157,376, filed on Oct. 1, 1999, provisional application No. 60/157,377, filed on Oct. 1, 1999, and provisional application No. 60/157,375, filed on Oct. 1, 1999.

(51) Int. Cl.[7] ..... H01J 49/24

(52) U.S. Cl. ..... 250/289; 250/291; 250/283; 250/299; 417/49

(58) Field of Search ..... 250/289, 291, 250/299, 283; 417/49

(56) References Cited

U.S. PATENT DOCUMENTS 3,057,996 A * 10/1962 Boyer ..... 250/289
3,591,827 A * 7/1971 Hall ..... 313/7
3,996,464 A * 12/1976 Fletcher et al. ..... 250/286

FOREIGN PATENT DOCUMENTS

GB 2026231 A * 1/1980 ..... H01J/49/24

* cited by examiner

*Primary Examiner*—Jack Berman

(57) ABSTRACT

A mass spectrometer (MS) which uses the Fourier transform ion cyclotron resonance (FTICR) technique to determine the mass of ions. The MS is prepared with a surface that guarantees that a particle striking the surface will have at least one contact with the cathode and will most likely be re-pumped before escaping into the vacuum chamber volume.

1 Claim, 3 Drawing Sheets

TRIODE ION PUMP

PRIORITY OF INVENTION

This invention claims priority to the Provisional Application(s) 60/157,499 and 60/157,498 both filed Oct. 4, 1999 and 60/157,374, 60/157,375, 60/157,376, 60/157,377 all filed Oct. 1, 1999.

BACKGROUND

1. Field of the Invention

This invention relates to a mass spectrometer (MS) and more particularly to a MS which uses the Fourier transform ion cyclotron resonance (FTICR) technique to determine the mass of ions.

2. Description of the Related Art

When a gas phase ion at low pressure is subjected to a uniform static magnetic field, the resulting behavior of the ion is determined by the magnitude and orientation of the ion velocity with respect to the magnetic field. If the ion is at rest, or if the ion has only a velocity parallel to the applied field, the ion experiences no interaction with the field.

If there is a component of the ion velocity that is perpendicular to the applied field, the ion will experience a force that is perpendicular to both the velocity component and the applied field. This force results in a circular ion trajectory that is referred to as ion cyclotron motion. In the absence of any other forces on the ion, the angular and the applied field. This force results in a circular ion trajectory that is referred to as ion cyclotron motion. In the absence of any other forces on the ion, the angular frequency of this motion is a simple function of the ion charge, the ion mass, and the magnetic field strength:

$$\omega = qB/m \qquad \text{Eq. 1}$$

where: ω=angular frequency (radians/second)

q=ion charge (coulombs)

B=magnetic field strength (tesla)

m=ion mass (kilograms)

The FTICR MS exploits the fundamental relationship described in Equation 1 to determine the mass of ions by inducing large amplitude cyclotron motion and then determining the frequency of the motion. The first use of the Fourier transform in an ion cyclotron resonance mass spectrometer is described in U.S. Pat. No. 3,937,955 entitled "Fourier Transform Ion Cyclotron Resonance Spectroscopy Method And Apparatus" issued to M. B. Comisarow and A. G. Marshall on Feb. 10, 1976.

The ions to be analyzed are first introduced to the magnetic field with minimal perpendicular (radial) velocity and dispersion. The cyclotron motion induced by the magnetic field effects radial confinement of the ions; however, ion movement parallel to the axis of the field must be constrained by a pair of "trapping" electrodes. These electrodes typically consist of a pair of parallel-plates oriented perpendicular to the magnetic axis and disposed on opposite ends of the axial dimension of initial ion population. These trapping electrodes are maintained at a potential that is of the same sign as the charge of the ions and of sufficient magnitude to effect axial confinement of the ions between the electrode pair.

The trapped ions are then exposed to an electric field that is perpendicular to the magnetic field and oscillates at the cyclotron frequency of the ions to be analyzed. Such a field is typically created by applying appropriate differential potentials to a second pair of parallel-plate "excite" electrodes oriented parallel to the magnetic axis and disposed on opposing sides of the radial dimension of the initial ion population.

If ions of more than one mass are to be analyzed, the frequency of the oscillating field may be swept over an appropriate range, or be comprised of an appropriate mix of individual frequency components. When the frequency of the oscillating field matches the cyclotron frequency for a given ion mass, all of the ions of that mass will experience resonant acceleration by the electric field and the radius of their cyclotron motion will increase.

An important feature of this resonant acceleration is that the initial radial dispersion of the ions is essentially unchanged. The excited ions will remain grouped together on the circumference of the new cyclotron orbit, and to the extent that the dispersion is small relative to the new cyclotron radius, their motion will be mutually in phase or coherent. If the initial ion population consisted of ions of more than one mass, the acceleration process will result in a multiple isomass ion bundles, each orbiting at its respective cyclotron frequency.

The acceleration is continued until the radius of the cyclotron orbit brings the ions near enough to one or more detection electrodes to result in a detectable image charge being induced on the electrodes. Typically these "detect" electrodes will consist of a third pair of parallel-plate electrodes disposed on opposing sides of the radial dimension of the initial ion population and oriented perpendicular to both the excite and trap electrodes. Thus the three pairs of parallel-plate electrodes employed for ion trapping, excitation, and detection are mutually perpendicular and together form a closed box-like structure referred to as a trapped ion cell. FIG. 1 shows a simplified diagram for a trapped ion cell 12 having trap electrodes 12*a* and 12*b*; excite electrodes 12*c* and 12*d*; and detect electrodes 12*e* and 12*f*.

As the coherent cyclotron motion within the cell causes each isomass bundle of ions to alternately approach and recede from a detection electrode 12*e*, 12*f*, the image charge on the detection electrode correspondingly increases and decreases. If the detection electrodes 12*e*, 12*f* are made part of an external amplifier circuit (not shown), the alternating image charge will result in a sinusoidal current flow in the external circuit. The amplitude of the current is proportional to the total charge of the orbiting ion bundle and is thus indicative of the number of ions present. This current is amplified and digitized, and the frequency data is extracted by means of the Fourier transform. Finally, the resulting frequency spectrum is converted to a mass spectrum using the relationship in Equation 1.

Referring now to FIG. 2, there is shown a general implementation of a FTICR MS 10. The FTICR MS 10 consists of seven major subsystems necessary to perform the analytical sequence described above. The trapped ion cell 12 is contained within a vacuum system 14 comprised of a chamber 14*a* evacuated by an appropriate pumping device 14*b*. The chamber is situated within a magnet structure 16 that imposes a homogeneous static magnetic field over the dimension of the trapped ion cell 12. While magnet structure 16 is shown in FIG. 2 as a permanent magnet, a superconducting magnet may also be used to provide the magnetic field.

The sample to be analyzed is admitted to the vacuum chamber 14*a* by a sample introduction system 18 that may, for example, consist of a leak valve or gas chromatograph column. The sample molecules are converted to charged species within the trapped ion cell 12 by means of an ionizer 20 which typically consists of a gated electron beam passing through the cell 12, but may consist of a photon source or other means of ionization. Alternatively, the sample molecules may be created external to the vacuum chamber 14*a* by any one of many different techniques, and then injected along the magnetic field axis into the chamber 14*a* and trapped ion cell 12.

The various electronic circuits necessary to effect the trapped ion cell events described above are contained within an electronics package 22 which is controlled by a computer based data system 24. This data system 24 is also employed to perform reduction, manipulation, display, and communication of the acquired signal data.

SUMMARY OF THE INVENTION

A mass spectrometer (MS) is disclosed which uses the Fourier transform ion cyclotron resonance (FTICR) technique to determine the mass of ions. The MS is prepared with a surface that guarantees that a particle striking the surface will have at least one contact with the cathode and will most likely be re-pumped before escaping into the vacuum chamber volume.

DESCRIPTION OF THE PREFERRED EMBODIMENT(s)

The problem is that FTICR mass spectrometers require ultra high vacuum to operate. The pump initially used for the FTICR has a "diode" geometry. Ion pumps have the characteristic that the sputtering process that provides the sputtered titanium pumping surface, also dislodges a small fraction of the gas that has previously been "pumped". This effect can contribute an error in subsequent samples when sampling the same gas continuously as in process monitoring. This effect is most noticeable in the dislodging of permanent gases such as Argon and Helium since these gases are not chemically bonded to the reactive Titanium as other molecules are. Several pumps of different geometry have been used to reduce this effect. Subject of this invention is an improved triode geometry using an Anti Back Scatter (ABS) catcher to further reduce the chance that previously pumped molecules can be dislodged from the surface. Expected improvement is about 100 times the current technology.

The most widely used is a Varian Associates "Star Cell" geometry that reduces the energy of the high energy sputtering ions that collide with the Titanium surface thereby reducing the number of molecules that are dislodged from the pumping surface. It is not used to solve the problem because Varian has a patent in force and is about 100 times less effective than the proposed invention. In addition to the pump geometry to limit the secondary discharge effects, another Jencourt patent described in another disclosure provides a method by which the pump is turned off during the admission of a new gas sample thereby avoiding the problem. However, this is accomplished by use of a high voltage reed relay, which will have a finite lifetime. The proposed ABS catcher does not.

Figure 1:
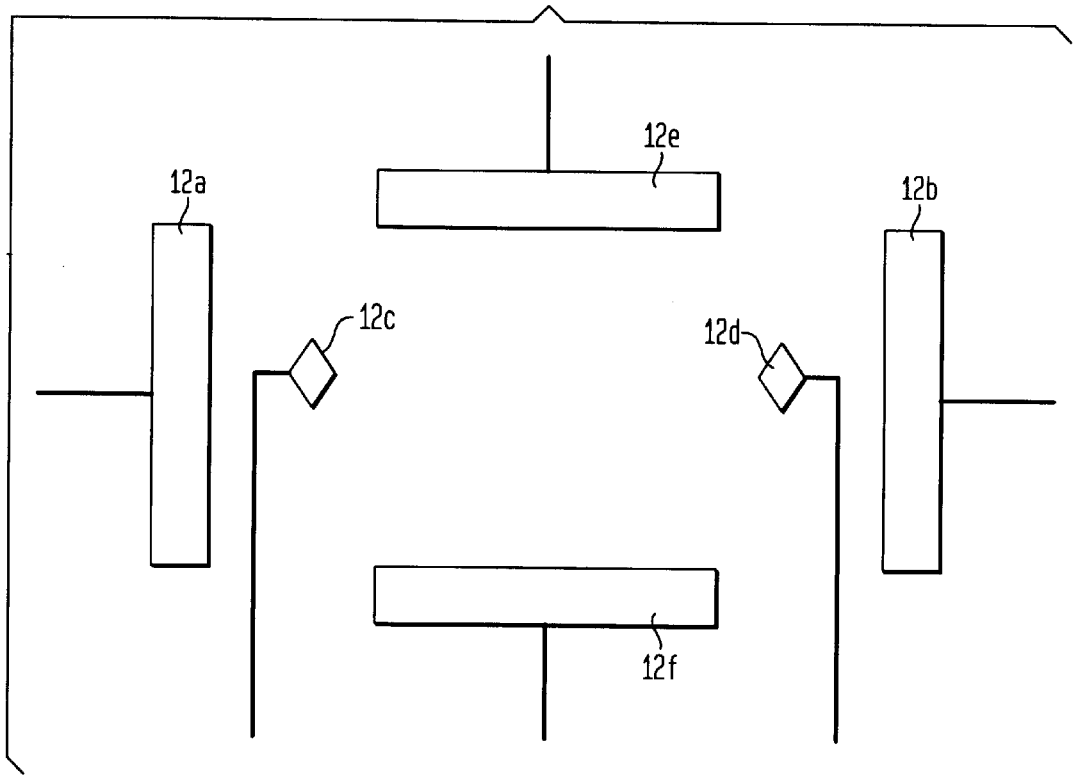
FIG. 1 shows a trapped ion cell.
Figure 2:
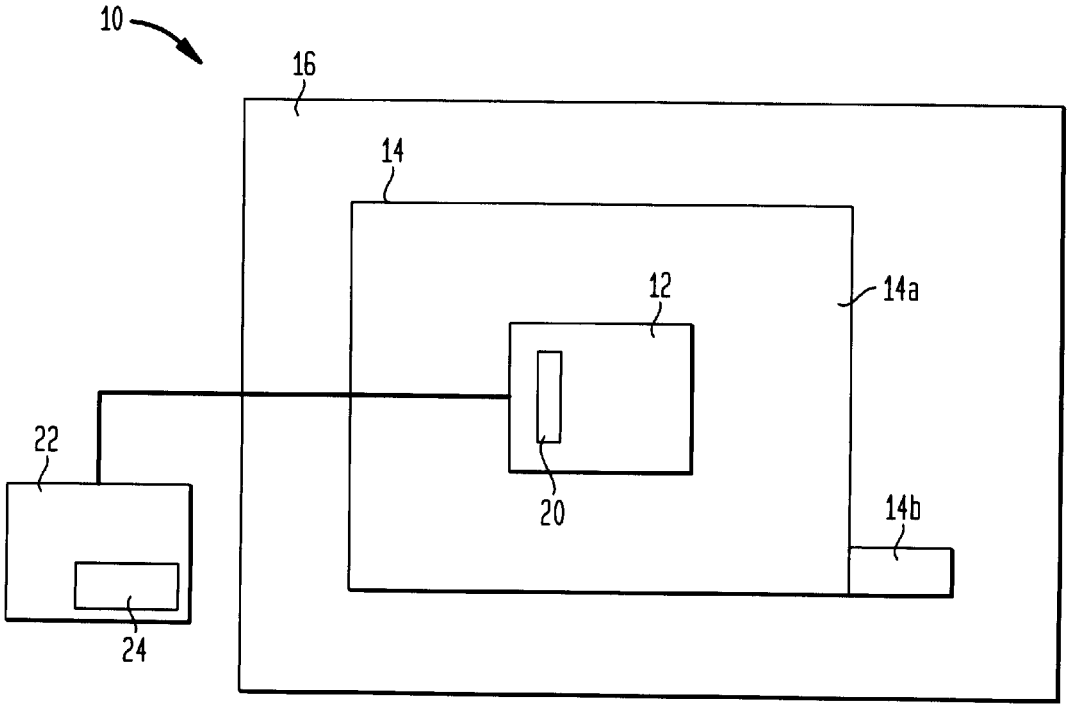
FIG. 2 shows a magnet structure.
Figure 3A:
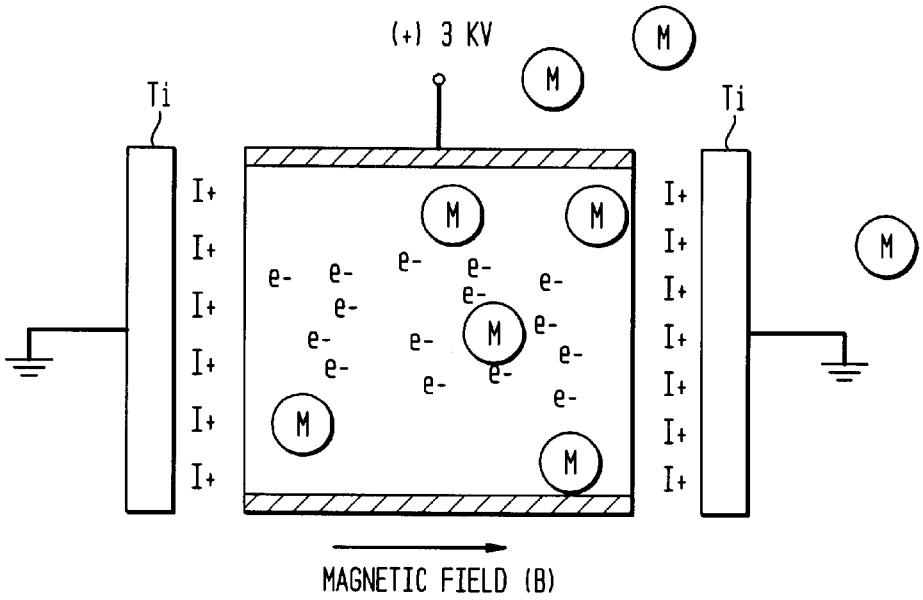
FIG. 3*a* shows a Penning Cell type ion pump.

The Ion Pump, in its most basic form, is a Penning Cell that has the function of trapping charged particles within the cell volume. Physically it consists of a right circular cylinder with a flat electrode made of Titanium at each end of the cylinder with the plane of the electrodes perpendicular to the axis of the cylinder. The three elements or electrodes are each electrically isolated from the others and are all immersed in a magnetic field of about 1200 Gauss with its axis coincident with the cylinder axis. Usually the Titanium electrodes are at a negative or ground potential while the cylinder is supplied with a positive 3000 volt potential. Electrons, initiated by field ionization, are trapped in the volume of the cylinder. When neutral molecules randomly find their way into the volume of the cell, they are bombarded with the energetic electrons and are broken apart or fragmented by stripping an electron from one or more of the molecular bonds. The remaining particle or ion is left with a net positive charge. It is repelled by the positive charge on the cylinder and is driven at high velocity into the Titanium cathode. Titanium metal is sputtered from the surface where it re-condenses to leave a very chemically reactive surface. Molecules contacting the surface are bonded chemically and "pumped". Permanent gases such as Argon and Helium are not chemically reactive and instead are buried by the sputtering and recondensing process. Much less energy is required to dislodge these permanent gases than the other chemically bonded molecules. (See FIG. 3*a*)

Figure 3B:
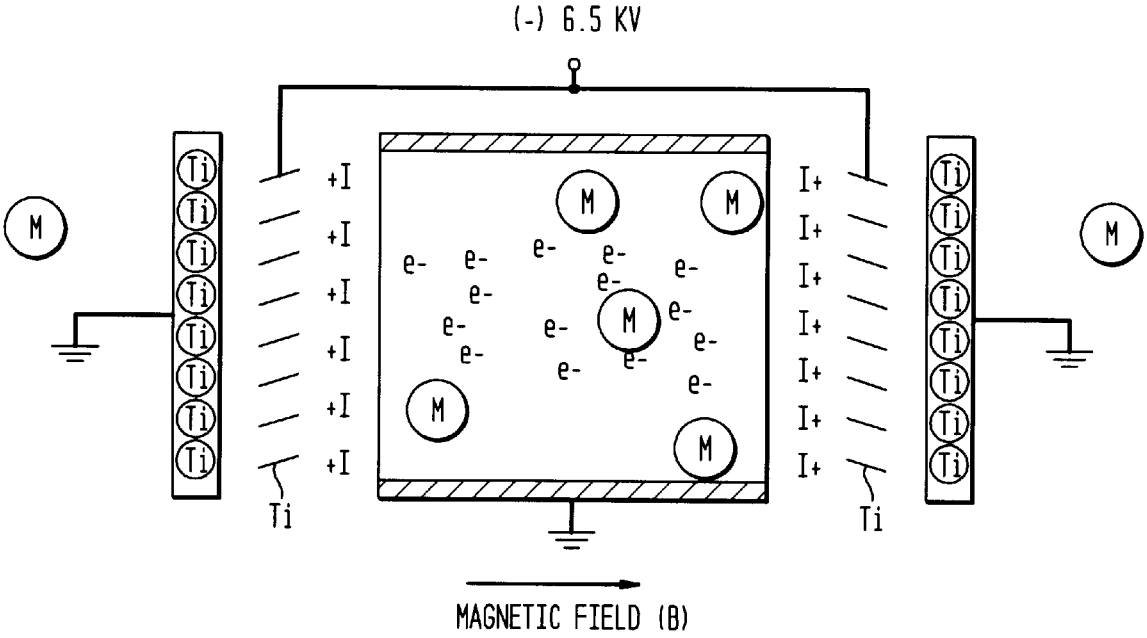
FIG. 3*b* shows a Varian Starr Cell.

The Varian Starr Cell with its triode geometry is shown in FIG. 3*b*. In this case the Anode and both cathodes are at ground potential while the Titanium sputtering cathode is typically supplied with a Negative 6500 volts D.C. The shape of the Titanium cathode assures a glancing angle collision with the energetic ions produced in the cell and accelerated toward the cathode. This reduces the number of high velocity ions that can strike the catcher cathodes and hence the number of dislodged pre-pumped molecules. However, this geometry still allows a large number of ions to be accelerated into the catcher and a significant number of secondary molecules are still dislodged.

Figure 4:
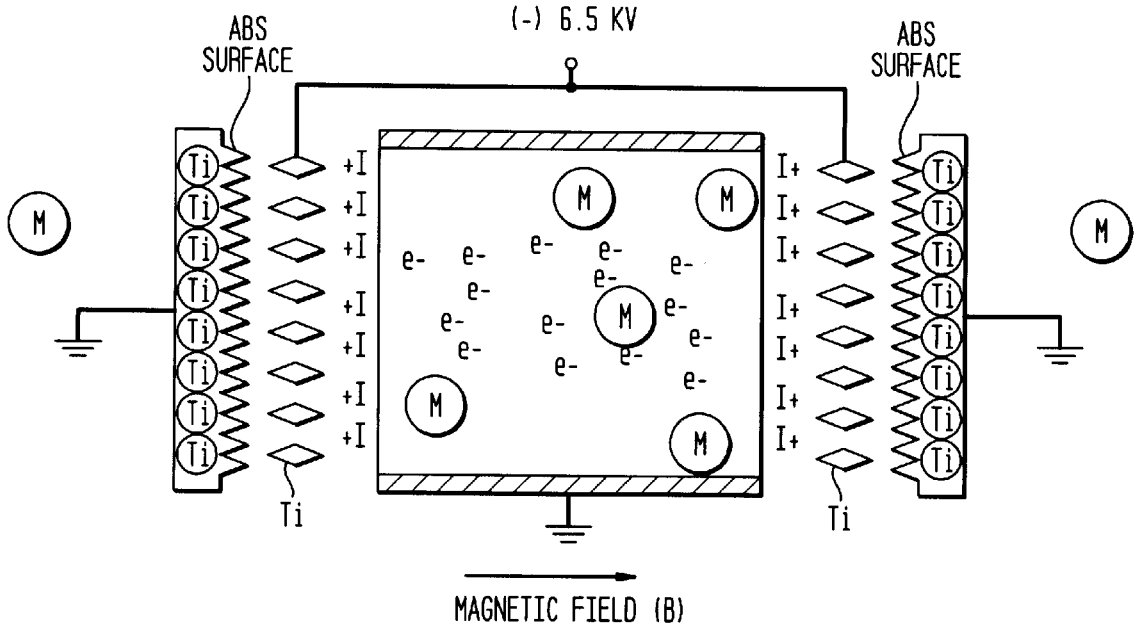
FIG. 4 shows an Anti Back Scatter Catcher.

This invention, the Anti Back Scatter Catcher, or ABS catcher shown in FIG. 4 is prepared with a surface that guarantees that a particle striking the surface will have at least one contact with the cathode. As a result, the particle(s) are re-pumped before escaping into the vacuum chamber volume. Preliminary tests show an improvement of a factor of a hundred. This level would probably not be detected and would allow removal of the reed relay controls currently in use.

Mass spectrometers have long been recognized as an analytical chemical technique desirable for use as a continuous monitor of chemical processes. In general, the attempts that have been made to this end started with instruments designed for laboratory applications.

As a consequence, the instruments are most likely to be more flexible and complex requiring operators in constant attendance and skilled in mass spectrometry if the full capability of mass spectrometry was to be realized. The trend in design direction has been toward creating environments within the hostile process plant environment that more closely resembles the laboratory environment targeted by the initial design.

The instruments resulting from these efforts are more expensive than necessary in several respects. First, The artificial environment housing is costly. The services, such as heating and cooling of the housing, are an on-going operating expense. Sampling systems to bring the sample of interest to the analyzer is complex and therefore expensive. These remote-sampling sites can be as much as several hundred feet from the instrument housing. Lifetimes of essential components such as vacuum pumps and sampling valves are of laboratory quality requiring frequent service downtime.

The principal mass analysis technologies that have been chosen are inherently limited by the physics. The performance of the instruments at their best operating conditions, are barely adequate for the assigned tasks. Quadrupole instruments require high sampling gas loads to give the sensitivity required by the application. In addition, electron multipliers (another method of increasing sensitivity) are likely to be poisoned by the high concentration of sample required. This will cause a degradation of performance. Coating of the analyzer electrodes will cause degradation as well. Downtime for cleaning as often as monthly has been experienced. Many of the same shortfall features are true of magnetic sector type instruments. Although the magnet sector instruments are inherently higher performance than the Quadrupole, only the lowest performance versions of the magnetic sector type instruments have had success in process control applications. The required high gas loads also require expensive vacuum pumps needing high power to operate. The types of pumps required can't recover from power failures without operator intervention or they must have very expensive automated systems to perform the recovery function.

As a consequence of these inherent limitations, annual sales of process mass spectrometer worldwide are only about 200 units.

The principal technologies described in the previous paragraph have been used in the absence of a better alternative.

As a result, process gas chromatography even with its high maintenance requirements and slow operation is still the dominate process control instrument in use today. In our view the problems inherent in these solutions have not been solved.

This invention is a combination of a newer mass spectrometer principal, new invention and features that are inherent in the components chosen that combine in unique ways to solve existing problems using mass spectrometers for process control and chemical monitoring applications. These features are listed along with a statement as to the contribution made to the end objective.

Principal of Operation. Fourier Transform Ion Cyclotron Resonance Mass Spectrometry (FTICR MS).

Mass range of the FTICR MS is (2–1000) amu. This mass range will be adequate for greater than 99% of chemical compounds that need measurement in the markets chosen. Resolution, the ability to distinguish between two masses that are nearly the same molecular weight, is 20,000 (@131 amu). This compares to unity or a resolution of (1) used by all other mass spectrometers offered for process applications.

Multi-channel detection—a complete spectra simultaneously for each measurement. This is compared to the other offerings in which each mass number is measured one at a time. This is known as a scanning mass spectrometer and depending on scanning speed, allows the process to change in the time required to scan the mass range needed to measure all the peaks necessary to define the chemical compound of interest. These instruments also use SIM or Selected Ion Monitoring in which the mass spectrometer measures a single selected ion to characterize a single event in a process stream. The instrument, in this mode, is blind to all other faults that may be happening. The Quadrupole operates in the SIM mode by adjusting the scan range to (1) amu. In the case of the Magnetic Sector, a fixed collector can be physically positioned to detect an ion of a specific molecular weight. No electron multiplier. Conventional mass spectrometers need electron multipliers, a device that significantly improves the detection limits of the measurement. This provides sensitivities that are equivalent to the FTICR. However, the electron multiplier is subject to degradation as a consequence of exposure to the chemicals measured which limit the long-term stability required of the application of process control. Re-calibration is about the only alternative.

Sensitivity—1 ppm Benzene in air. Detection limits of the FTICR are about equal to the conventional instruments if the electron multiplier, with its disadvantage, is acceptable.

Mixture Analysis—The FTICR, because of its physical principal, is capable of trapping charged particles for extended periods (seconds) of time under precise computer control. This feature is particularly useful for measuring a single chemical compound in a complex mixture. This is nearly always the requirement in process control applications. This technique has been demonstrated in research grade FTICR mass spectrometers and in general is called ion-molecule gas phase chemistry. A measurement would include;

Using a reagent gas to form reagent ions. Introduction of the sample gas mixture where one component of which will react uniquely with the reagent ions. The product of the reaction, if the component is present in the mixture, is measured as part of the same measurement. This measurement can be performed under computer control as a "method" without an operator in attendance.

Development of these specific ion-molecule reactions may be unique to the chemical product. Manufacture of the product could then be dependent on the specific monitoring technique and thereby worthy of patent protection.

FTICR mass spectrometry is a pulsed analysis technique. This feature is a main reason that the FTICR was chosen for this application. Sample gas is momentarily admitted to the analyzer chamber by way of a pulsed valve. The sample pressure rises in the vacuum chamber to a value (100) times the background pressure. A sample of the gas is converted to ions by bombarding the sample gas molecules with an electron beam. The ions are trapped while the remainder of the sample gas is pumped away by the integral ion pump. The subsequent analysis is completed and the process is repeated at a rate up to about ten times per second. Because of this pulsed mode of operation, very small vacuum chambers are used to limit the total amount of gas to be pumped. This is important since cost and reliability of mass spectrometers are determined in very large part by the vacuum systems necessary for their operation. Conventional mass spectrometers must operate in a continuous mode and because of higher gas loads necessary for sensitivity, need vacuum pumps with more than ten thousand times the capacity required by the FTICR of this design.

FTICR-MS Sample gas load—Gas load necessary for the maximum sampling rate is 3×E−9 torr-l/sec while conventional mass spectrometers require 3×E−5 torr-l/sec. or 10,000 times the amount of gas that must be pumped by the vacuum system.

Vacuum pump—Integral Ion Pump—The vacuum pump used for the FTICR-MS is an ion pump of a measured pumping speed of 240 l/sec. The pump is an integral part of the vacuum chamber that houses the analyzer and uses, for the pump, the same (1) Tesla magnetic field necessary for the mass spectrometer analyzer. This integral configuration eliminates the need for conventional vacuum flanges that would add significantly to the volume of gas that must be pumped and to the weight and cost of the system.

Pump power—Power to operate the ion pump at the maximum sampling rate is about (0.1) watt. The conventional pumps required of other mass spectrometers offered for these applications are greater than (500) watts and use rotating pumps with periodic maintenance requirements. These pumps also have environmental waste disposal requirements. The ion pump does not.

Pump lifetime Ion pump lifetimes based on thirty years of operating history of the pump types are calculated at greater than (100) years with this instrument in the applications selected.

Pump Maintenance—None for the FTICR. Lifetimes of pumps used in the alternative mass spectrometers, with the periodic maintenance required, are about (5) years. Maintenance frequency is about six months and requires system, thereby process, downtime.

Recovery from power failure—A key feature of the ion pump as compared to the pumps required of the conventional mass spectrometers. The ion pump is fail-safe in that when power is lost, the vacuum integrity is not compromised and when restored, simply begins taking data again without the need for operator intervention. The conventional systems must have operator intervention to restart them or must have a very elaborate and expensive automated restart system.

Pump Cost—Cost of the integral ion pump for this FTICR mass spectrometer is approximately $200. Costs of pumps for the conventional mass spectrometers will be $ 3,000 to $ 5,000. Conventional pumps are Turbomolecular or oil diffusion pumps.

Vacuum Volume—The FTICR MS has a total vacuum chamber volume of (0.35 liters) including the volume occupied by the ion pump. Volume of the conventional mass spectrometers will have ten to a hundred times the volume of the Jencourt FTICR MS. Volume to be pumped and the sample pressure required to achieve the sensitivity determine the gas volume. The greater the volume that must be pumped, the greater the cost and power requirements of the system.

Operating temperature—300 deg C.—All parts of the system that come in contact with the sample to be measured can be maintained at up to the 300 deg C. This provides the broader ability to measure sample streams requiring high temperature to remain in the gas phase.

Sampling—The FTICR MS operates at a base pressure of 1×E−10 torr. Ideally, sample ions would be formed with the sample pressure at least one hundred times the background and the chamber returned to the base pressure before performing the analysis. This is accomplished by introducing the sample gas through a pulsed valve designed for the purpose. In practice, a valve "on" time of 1 msec will raise the pressure from 1×E−10 torr to 1×E−8 torr. The sample is ionized and sample ions trapped. The ion pump pumps the unused sample molecules away and the pressure returns to the 1×E−10 base pressure in about forty msec.

The analysis is then performed in the ultra high vacuum that remains. Valve lifetimes of greater than (1) Bil. Samples or (3 yrs) at (10) samples per second have been measured. New inventions provide features of the subject system that do not exist in other FTICR MS. All of the inventions disclosed for patent applications that will find application in the FTICR MS are listed with the unique contribution to the system performance.

New Inventions

Pulsed valve (Seat Formation Method—Controlled Energy Closing)—This design will be used to achieve the system performance in terms of the extended lifetimes of the sampling valve. There is no other valve known that will provide the performance described in the system disclosure.

Integral Ion Pump—failsafe—high magnetic field—high pumping speed—auto recovery from power loss.

Switched vacuum pump—failsafe—static sample storage for ion molecule chemical reaction—sample conservation for ultimate sensitivity.

Improved triode pump—fail safe—reduced back ground effects to improve performance in the future.

Precision pressure measurement—Experiment timing—minimum gas load—This feature uses the pump current as a high sensitivity, high precision monitor of transient pressure to establish the time at which the electron ionization event must happen to achieve maximum sensitivity. No other mass spectrometer or commercial pressure gage has had the capability of determining the pressure in real time as this one does. In addition to the high speed of response (bandwidth of the measurement) the close coupling of the integral ion pump to the analyzer assures that the pressure measured is the pressure very close to the analyzer. This function assures that the sample residence time in the chamber is no longer than is necessary to capture a representative set of sample ions.

Magnetron total ion measurement—High precision relative concentration—This invention measure the total number of ions formed in each measurement even if the mass numbers fall outside the range that will subsequently be measured. With this information, a precise value of relative concentration of each measured component to the total can be calculated automatically by the "method".

Automatic background peak ejection—Extended detection limits—This automatically calculates the excite signals to eject unwanted sample ions in order to preferentially measure important trace components of the sample mixture with the highest sensitivity or lowest detection limits. Although the technique has been applied as a manually performed experiments in research grade FTICR instruments, it has not been used in the automatic manner proposed and required for the unattended system operation proposed in this system patent disclosure.

Fingerprint tracking—automatic "stranger I.D."—The basic application of the FTICR MS system is to continuously measure chemical features of process mixtures and record them as a function of time. This "tracking" will be monitored by an operator or by a "host" computer that responds to the measurement data to control process plants or functions. The mass spectrometer is a generic chemical detector but as a practical matter, the measurement "method" will select a subset of the total mixture spectra to characterize the quality and quantity of a process stream. In selecting a subset of the total, the mass spectrometer is "blinded" to unpredicted components that could appear in the stream as a consequence of a fault in the process. Fingerprint Tracking, refers to the fact that on a programmed periodic basis, a full mass spectrum is taken and recorded. The fingerprint initially stored is the fingerprint of an acceptable process. If subsequent fingerprints are compared successively by subtracting one from the other peak by peak, the difference spectrum will indicate a "stranger" component in the process. Automatic alarms are triggered and an automatic library search initiated to identify the "stranger". This provides the basis for a remedy.

Electron resonance ionization—Increased sample rate reduced ion-molecule reaction—This technique provides a way to control the electron beam that will reduce by a factor of a hundred the time required to produce a given number of sample ions. This can also be used to produce a greater number of ions in the same time for higher sensitivity.

Aluminum insulators—low cost high reliability cell insulators—The insulators produced by the method described in the disclosure contribute to the system first in cost to produce but also to provide a much more robust component for system reliability.

Automatic method development—Fast method development (Jencourt or user)—The system enhancement provided by this concept addresses the fundamental market issue of technological acceptance by the end user of the product. Mass spectrometer suppliers to the process markets have, in general, produced "canned or prepared methods" with the instruments for applications to specific processes. This makes the end user of the instrument dependent on the instrument supplier for a successful use of the instrument for the application intended. The alternative has been that a few end users have felt competent enough in the technology to develop the method themselves. Neither of these approaches has resulted in wide spread use of mass spectrometers. To the contrary, it has more often ended as an unsuccessful attempt at great cost and dissatisfaction. To speed up the method development process, a automated method development process has been designed that eliminates the empirical approach now being used. The technique will apply whether the vendor, at the customers election, or the customer develops the "method"

Programmed electron flux—Precision measurement repeatability—This function enhances the system by increasing significantly the precision with which a measurement can be repeated.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An ion pump wherein charged particles, which are initiated by field ionization in a vacuum chamber volume, bombard samples immersed in a magnetic field, said samples break apart due to the bombardment yielding an oppositely charged fragment, which is driven to a detection cathode, said ion pump comprising a surface of said detection cathode wherein a particle striking the surface will have at least one contact with the cathode, thereby causing the fragment to be re-pumped before escaping into the vacuum chamber volume.

* * * * *